US009894449B2

(12) United States Patent
Kwon et al.

(10) Patent No.: US 9,894,449 B2
(45) Date of Patent: Feb. 13, 2018

(54) EAR MOLD FOR AUDITORY DEVICE

(71) Applicant: Samsung Electronics Co., Ltd., Gyeonggi-do (KR)

(72) Inventors: Seeyoun Kwon, Seoul (KR); Yong Sang Yun, Gyeonggi-do (KR)

(73) Assignee: Samsung Electronics Co., Ltd (KR)

( * ) Notice: Subject to any disclaimer, the term of this patent is extended or adjusted under 35 U.S.C. 154(b) by 0 days.

(21) Appl. No.: 15/161,793

(22) Filed: May 23, 2016

(65) Prior Publication Data

US 2017/0048631 A1 Feb. 16, 2017

(30) Foreign Application Priority Data

Aug. 12, 2015 (KR) ..... 10-2015-0083403

(51) Int. Cl.
*H04R 25/00* (2006.01)
*H04R 1/10* (2006.01)

(52) U.S. Cl.
CPC ..... *H04R 25/652* (2013.01); *H04R 1/1016* (2013.01); *H04R 1/1041* (2013.01); *H04R 25/604* (2013.01); *H04R 2225/021* (2013.01)

(58) Field of Classification Search
CPC ..... H04R 2460/17; H04R 2225/023; H04R 2225/025; H04R 1/10; H04R 2205/022; H04R 2460/13; H04R 1/1016
USPC ..... 381/325, 328, 373, 380
See application file for complete search history.

(56) References Cited

U.S. PATENT DOCUMENTS 3,935,401 A * 1/1976 Shore ..... H04R 1/1016 181/135
6,724,902 B1 * 4/2004 Shennib ..... H04R 25/456 381/322
8,208,676 B2 * 6/2012 Murozaki ..... H04R 1/1016 381/380
8,270,657 B2 * 9/2012 Takigawa ..... H04R 1/1041 381/372
8,515,116 B2 * 8/2013 Lee ..... H04R 1/1041 381/338
8,755,548 B2 * 6/2014 Zhao ..... H04R 25/656 381/325
2004/0105562 A1 * 6/2004 Kulman ..... H04R 25/654 381/325
2005/0244026 A1 * 11/2005 Nielsen ..... H04R 25/652 381/380
2007/0201717 A1 * 8/2007 Dyer ..... H04R 1/1016 381/380

(Continued)

*Primary Examiner* — Suhan Ni
(74) *Attorney, Agent, or Firm* — The Farrell Law Firm, P.C.

(57) ABSTRACT

A portable device is provided and includes an earpiece including a receiver configured to convert an electric signal into a sound signal and an ear mold configured to be coupled to the earpiece. The ear mold including cylinder formed about a first axis of the ear mold and including an inner side and an outer side, a first cap extending from one end of the cylinder and a second cap disposed adjacent to the first cap and extending parallel in relation to at least a part of the first cap, wherein the first cap has a first hole passing through a first side of the first cap and a second side, which is disposed opposite the first side, and the second cap has a second hole passing through a third side of the second cap and a fourth side, which is disposed opposite the third side.

18 Claims, 22 Drawing Sheets

(56) References Cited

U.S. PATENT DOCUMENTS

| | | | |
|---|---|---|---|
| 2015/0030196 | A1 | 1/2015 | Basseas et al. |
| 2015/0055809 | A1 | 2/2015 | Rasmussen et al. |

* cited by examiner

EAR MOLD FOR AUDITORY DEVICE

PRIORITY

This application claims the priority under 35 U.S.C. § 119(a) to Korean Patent Application Serial No. 10-2015-0083403, which was filed in the Korean Intellectual Property Office on Jun. 12, 2015, the entire contents of which is incorporated herein by reference.

BACKGROUND

1. Field of the Disclosure

The present disclosure relates generally to a wearable device, and more particularly, to an ear mold for an auditory device that is worn in the ears of a user.

2. Description of the Related Art

The electronic devices may be carried by putting the same into a user's pocket or bag; holding the same by hand; or wearing the same on a specific position of a human body. The wearable device may be worn on a variety of human body parts to then be used.

The methods for wearing the wearable device on the body may include: 1. a method of wearing the watch type of device on the body part, such as a wrist; 2. a method of wearing the necklace type of device around the neck; 3. a method of wearing the glasses type of device in a similar manner of wearing glasses on the face; 4. a method of fitting the clip type of device to a part of the body, clothing, or belongings; or 5. a wearing method of directly/indirectly attaching the body, belongings, or accessories.

In addition, with regards to the schematic configuration of the wearable device, the wearable device is comprised of a body and a wearing part, and the wearable device may be worn on the various body parts depending on the configuration of the wearing part. The electronic device that is worn in the ears among the various body parts may be referred to as an auditory device. In general, users may obtain sound information through the auditory device.

FIG. 1 is a view showing an example of the wearing state of the general auditory devices.

Referring to FIG. 1, by using the respective auditory devices 10 and 11, the user may listen to music, or the sound information of phone calls and the surroundings may be amplified to then be provided to the user. The auditory device 10 or 11 may be worn on the body parts (ears, a head, or a neck) of the user, and a receiver (speaker) of the electronic device may provide the sound information around the ears.

Each auditory device 10 or 11 may have a variety of forms depending on the personal using purpose of the user. For example, the auditory device 10 or 11 may be referred to as a headset, headphones, earpieces, hearing aids, or personal sound amplification products. The auditory devices 10 and 11, such as the hearing aids, may be implemented as the behind-the-ear (BTE) type, the receiver-in-canal (RIC) type, the in-the-ear (ITE) type, the in-the-canal (ITC) type, the completely-in-canal (CIC) type, or the like.

The auditory devices have used the open-type of ear mold or the closed-type of ear mold. However, while the open-type of ear mold has a low possibility of generating feedback (howling), it has a problem in which the user's voice becomes louder. In addition, the closed-type of ear mold provides a comfortable fit, while the generation of feedback will increase.

SUMMARY

Various embodiments of the present disclosure provide an auditory device that can be selectively used as the open-type of ear mold or as the closed-type of ear mold.

In accordance with an aspect of the present disclosure, there is provided a portable device. The portable device includes an earpiece including a receiver configured to convert an electric signal into a sound signal and an ear mold configured to be coupled to the earpiece and including a cylinder formed about a first axis of the ear mold and including an inner side that surrounds at least a part of the receiver and an outer side that is disposed opposite the inner side, a first cap extending from one end of the cylinder and including a portion spaced apart from the outer side of the cylinder and surrounding at least a part thereof, and a second cap disposed adjacent to the first cap and extending parallel in relation to at least a part of the first cap, wherein the first cap has a first hole passing through a first side of the first cap and a second side, which is disposed opposite the first side, and the second cap has a second hole passing through a third side of the second cap and a fourth side, which is disposed opposite the third side.

In accordance with an aspect of the present disclosure, there is provided an auditory device including a receiver and at least one ear mold coupleable to the receiver and operable in a first configuration and a second configuration, such that in the first configuration a though hole of the ear mold is in an open configuration and in the second configuration the through hole is in a closed configuration.

In accordance with an aspect of the present disclosure, there is provided a wearable device including a microphone, an ear mold coupleable to a receiver and operable in an open configuration for opening a path between an inner ear and an outer ear of a user of the wearable device and a closed configuration for blocking the path between the inner ear and the outer ear, the ear mold including a first ear dome and a second ear dome that is rotatably coupled to the first ear dome for operating the ear mold in the open configuration and the closed configuration, and a tube configured to connect the receiver to the microphone.

BRIEF DESCRIPTION OF THE DRAWINGS

The above and other aspects, features, and advantages of certain embodiments of the present disclosure will be more apparent from the following detailed description taken in conjunction with the accompanying drawings, in which.

DETAILED DESCRIPTION

Figure 1:
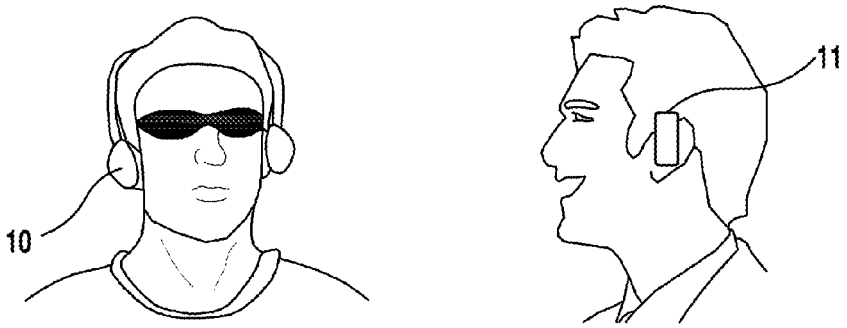
FIG. 1 is a diagram illustrating examples of conventional auditory devices, shown worn by a user.

Embodiments of the present disclosure will be described herein below with reference to the accompanying drawings. However, the embodiments of the present disclosure are not limited to the specific embodiments and should be construed as including all modifications, changes, equivalent devices and methods, and/or alternative embodiments of the present disclosure.

The terms "have," "may have," "include," and "may include" as used herein indicate the presence of corresponding features (for example, elements such as numerical values, functions, operations, or parts), and do not preclude the presence of additional features.

The terms "A or B," "at least one of A or/and B," or "one or more of A or/and B" as used herein include all possible combinations of items enumerated with them. For example, "A or B," "at least one of A and B," or "at least one of A or B" means (1) including at least one A, (2) including at least one B, or (3) including both at least one A and at least one B.

The terms such as "first" and "second" as used herein may modify various elements regardless of an order and/or importance of the corresponding elements, and do not limit the corresponding elements. These terms may be used for the purpose of distinguishing one element from another element. For example, a first user device and a second user device may indicate different user devices regardless of the order or importance. For example, a first element may be referred to as a second element without departing from the scope the present invention, and similarly, a second element may be referred to as a first element.

It will be understood that, when an element (for example, a first element) is "(operatively or communicatively) coupled with/to" or "connected to" another element (for example, a second element), the element may be directly coupled with/to another element, and there may be an intervening element (for example, a third element) between the element and another element. To the contrary, it will be understood that, when an element (for example, a first element) is "directly coupled with/to" or "directly connected to" another element (for example, a second element), there is no intervening element (for example, a third element) between the element and another element.

The terms used in describing the various embodiments of the present disclosure are for the purpose of describing particular embodiments and are not intended to limit the present disclosure. As used herein, the singular forms are intended to include the plural forms as well, unless the context clearly indicates otherwise. All of the terms used herein including technical or scientific terms have the same meanings as those generally understood by an ordinary skilled person in the related art unless they are defined otherwise. The terms defined in a generally used dictionary should be interpreted as having the same or similar meanings as the contextual meanings of the relevant technology and should not be interpreted as having ideal or exaggerated meanings unless they are clearly defined herein. According to circumstances, even the terms defined in this disclosure should not be interpreted as excluding the embodiments of the present disclosure.

The term "module" as used herein may be defined as, for example, a unit including one of hardware, software, and firmware or two or more combinations thereof. The term "module" may be interchangeably used with, for example, the terms "unit", "logic", "logical block", "component", or "circuit", and the like. The "module" may be a minimum unit of an integrated component or a part thereof. The "module" may be a minimum unit performing one or more functions or a part thereof. The "module" may be mechanically or electronically implemented. For example, the "module" may include at least one of an application-specific integrated circuit (ASIC) chip, field-programmable gate arrays (FPGAs), or a programmable-logic device, which is well known or will be developed in the future, for performing certain operations.

An electronic device of the disclosure may be a device including a communication function. For example, an electronic device may include at least one of a smartphone, a tablet personal computer (PC), a mobile phone, a video phone, an e-book reader, a desktop PC, a laptop PC, a netbook computer, a personal digital assistant (PDA), a portable multimedia player (PMP), an MP3 player, a mobile medical device, a camera, or a wearable device (e.g., a head-mounted-device (HMD) such as electronic glasses, an electronic clothing, an electronic bracelet, an electronic necklace, an electronic appcessory, an electronic tattoo, or a smartwatch).

According to certain embodiments, an electronic device may be a smart home appliance having a communication function. A smart home appliance may include, for example, at least one of a television, a digital video disk (DVD) player, an audio, a refrigerator, an air conditioner, a cleaner, an oven, an electronic range, a washing machine, an air purifier, a set-top box, a TV box (e.g., Samsung Home-Sync™, Apple TV™, or Google TV™), game consoles, an electronic dictionary, an electronic key, a camcorder, or an electronic frame.

According to certain embodiments, an electronic device may include at least one of various medical devices (e.g., magnetic resonance angiography (MRA), magnetic resonance imaging (MRI), computed tomography (CT), a shooting device, an ultrasonic device, etc.), a navigation device, a global positioning system (GPS) receiver, an event data recorder (EDR), a flight data recorder (FDR), an automobile infotainment device, electronic equipment for a ship (e.g., a navigation device for a ship, a gyro compass, etc.), an avionics, a security device, or a robot for an industrial use or a home use.

According to certain embodiments, an electronic device may include at least one of a furniture or a portion of a building/structure including a communication function, an electronic board, an electronic signature receiving device, a projector, or various measurement devices (e.g., waterworks, electricity, gas, or radio wave measuring device, etc.). An electronic device according to the disclosure may be a combination of one or more of the above-described devices. Also, it will be apparent to one skilled in the art that the electronic device examples of the disclosure are not limited to the above-described devices.

An electronic device according to the present disclosure is described with reference to the accompanying drawings. A user used may indicate a person who uses an electronic device or a device (e.g., an artificial intelligence electronic device) that uses the electronic device.

Figure 2:
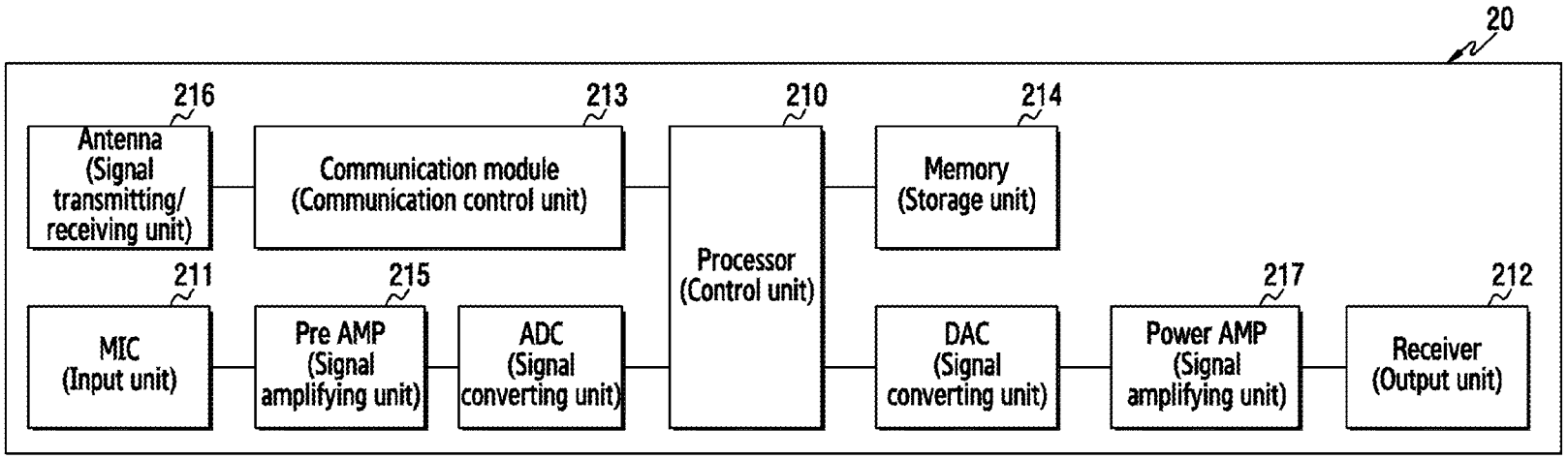
FIG. 2 is a diagram illustrating a configuration of an auditory device, according to an embodiment of the present disclosure.

FIG. 2 is a diagram illustrating a configuration of an auditory device, according to an embodiment of the present disclosure.

Since the various embodiments of the present disclosure may selectively switch to the open-type of ear mold or to the closed-type of ear mold depending on the user's preference, it is convenient to use the same.

In addition, according to various embodiments of the present disclosure, the receiver and the ear dome can be easily coupled and detached, and the first and second ear domes can be easily coupled and detached, as well.

In addition, the various embodiments of the present disclosure can provide a comfortable fit for the ear canal by adopting a soft material. In particular, since the rotation operation of the ear dome is easy, it is convenient to use the same.

Referring to FIG. 2, the auditory device 20, according to various embodiments, may be a wearable device that can be worn on the body parts (for example, on the ears, around the ears, or in the ear canal), and may include a control unit 210, an input unit 211, such as a microphone (MIC), an output unit 212 (a receiver/speaker), a communication control unit 213 (a communication module), and a storage unit 214 (a memory). The auditory device 20 may generate an input signal through the input unit 211 by using sound information. The control unit 210 may process the input signal (applying an audio filter or amplifying the signal) in order to thereby output a sound through the output unit 212. The auditory device 20 may further include a signal amplifying unit 215 or 217 amplifier (AMP) to amplify analog signals.

The auditory device 20, according to various embodiments, may be wiredly or wirelessly connected to other electronic devices (mobile devices, mobile phones, tablets, or the like) and a network. In the case of a wireless connection, the communication control unit 213 may process an input signal (applying an audio filter or amplifying the signal) that is received through an antenna 216, and may transmit the same to the control unit 210. The control unit 210 may process the input signal and may then output a sound through the output unit 212.

The control unit 210, according to various embodiments, may differently configure the signal processing method (applying an audio filter or amplifying the signal) depending on the input signal that is received through the communication control unit 213 or the input unit 211. The control unit 210 may set an audio path according to the presence or absence of the input signal through the communication control unit 213 and the input unit 211. For example, in the case of a normal mode, the input signal is input to the control unit 210 through the input unit 211. The control unit 210 may set a signal path of the input unit 211 to the output unit 212, and may then output a sound. If there is an input signal through the communication control unit 213, the control unit 210 may convert the signal path through the input unit 211 into the signal path through the communication control unit 213.

The control unit 210, according to various embodiments, may process information on whether or not an input signal is received through the input unit 211 by using the intensity of power for each time period. If there is an input signal, the control unit 210 may analyze the input signal in order to thereby determine the mode to be performed. The control unit 210 may determine whether or not the input signal is similar to the signal of a user, the signal of an object, or the signal that is registered in a DB. The mode of the auditory device 20 may be changed according to the voice information of the input signal. If the input signal is determined to be a noise, the control unit 210 may eliminate the same. If the input signal does not occur more than a specific value for a specific period of time, at least some of the auditory device 20 may operate in the low power mode.

Figure 3:
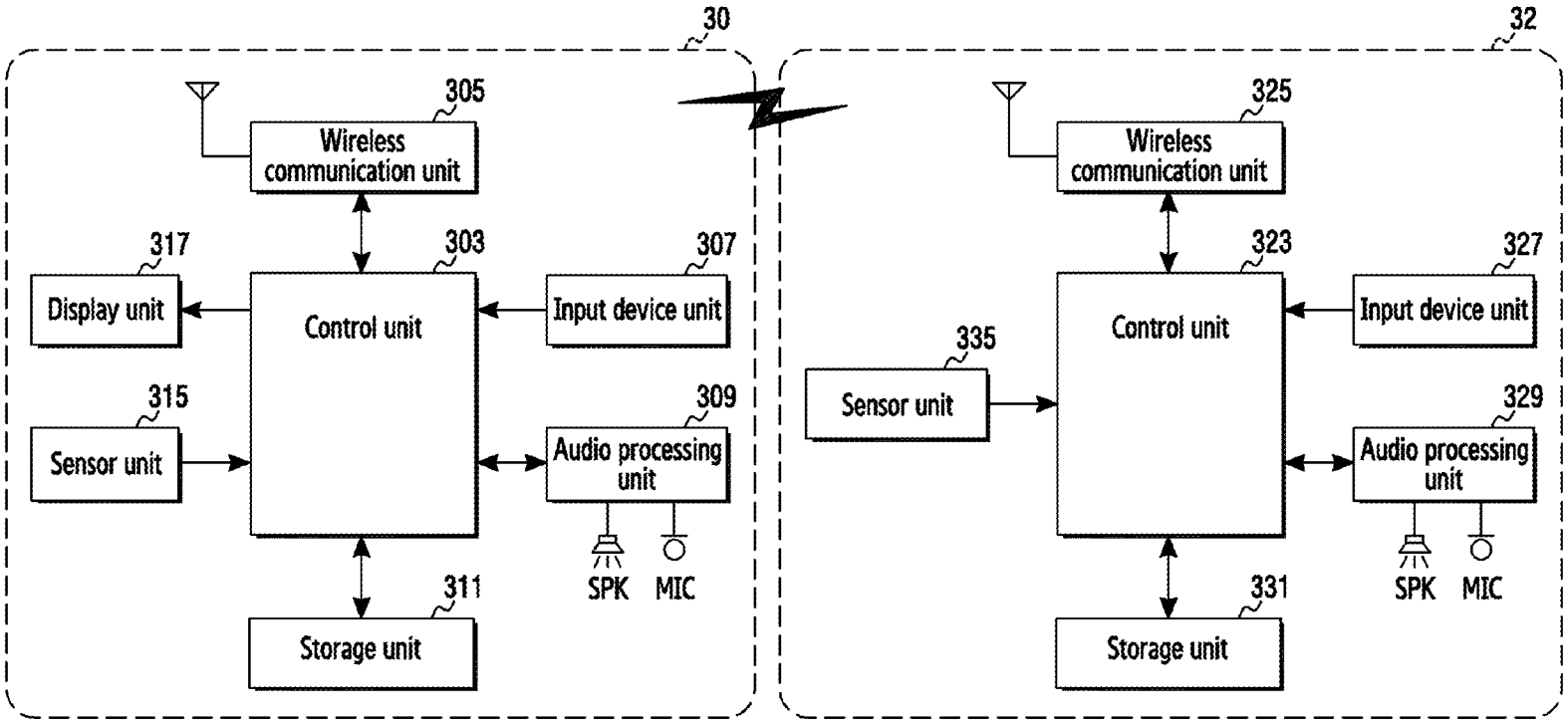
FIG. 3 is a diagram illustrating a configuration of a wireless communication system, according to an embodiment of the present disclosure.

FIG. 3 is a diagram illustrating a configuration of a wireless communication system, according to an embodiment of the present disclosure.

Referring to FIG. 3, the auditory device 32, according to various embodiments, may communicate with the other electronic device 30 (mobile devices, mobile phones, tablets, or the like). The auditory device 32 and the other electronic device 30 may be paired with each other by wireless communication, such as radio frequency (RF), NFMI (Near Field Magnetic Induction), Bluetooth (BT), audio over Bluetooth low energy (AoBLE), or the like. For example, the electronic device 30, which is connected to the auditory device 32, may be a mobile terminal. The mobile terminal may transmit sound information (such as, the reproduction of music, the call reception, an alarm, or an input signal of a terminal microphone) to the auditory device 32.

The electronic device 30, according to various embodiments, may include one or more control units 303, a wireless communication unit 305, a storage unit 311, a sensor unit 315, an input device unit 307, a display unit 317, and an audio processing unit 309.

The control unit 303, according to various embodiments, may control a multitude of hardware or software elements that are connected with the control unit, and may perform the processing of various pieces of data and a calculation, for example, by driving an operating system or application programs. The control unit 303 may be implemented by, for example, a system on chip (SoC). According to an embodiment, the control unit 303 may further include a graphic processing unit (GPU) and/or an image signal processor. The control unit 303 may load instructions or data received from one or more other elements (e.g., a non-volatile memory) to a volatile memory to then process the same, and may store a variety of data in a non-volatile memory.

The wireless communication unit 305, according to various embodiments, may include, for example, a cellular module, a wireless fidelity (WiFi) module, a Bluetooth module, a global navigation satellite system (GNSS) module (e.g., a global positioning system (GPS) module, a Glonass module, the Beidou module, or the Galileo module), an near field communication (NFC) module, and a radio frequency (RF) module.

The cellular module, for example, may provide services of voice calls, video calls, text messaging, or the Internet through communication networks. According to an embodiment, the cellular module may perform identification and verification of the electronic device 30 in communication networks by using a subscriber identification module (e.g., a SIM card). The cellular module may perform at least some of the functions that are provided by the processor. The cellular module may include a communication processor (CP).

For example, each of the WiFi module, the Bluetooth module, the GNSS module, or the NFC module may include a processor for processing data that is transmitted and received through the corresponding module. According to an embodiment, at least some (e.g., two or more) of the cellular module, the WiFi module, the Bluetooth module, the GNSS module, or the NFC module may be included in one integrated chip (IC) or one IC package.

The RF module, for example, may transmit and receive communication signals (e.g., RF signals). The RF module may include, for example, a transceiver, a power amplifier module (PAM), a frequency filter, a low noise amplifier (LNA), antennas, or the like. According to another embodiment, at least one of: the cellular module; the WiFi module; the Bluetooth module; the GNSS module; or the NFC module may transmit and receive RF signals through separated RF modules.

The subscriber identification module (SIM) card may be an embedded SIM, and may include inherent identification information (e.g., an integrated circuit card identifier (ICCID)) or subscriber information (e.g., an international mobile subscriber identity (IMSI)).

The storage unit 311, according to various embodiments, may include, for example, an internal memory or an external memory. The internal memory, for example, may include at least one of: volatile memories (e.g., a dynamic random access memory (RAM) (DRAM), a static RAM (SRAM), a synchronous dynamic RAM (SDRAM), or the like); or non-volatile memories (e.g., an one time programmable read only memory (ROM) (OTPROM), a programmable ROM (PROM), an erasable and programmable ROM (EPROM), an electrically erasable and programmable ROM (EEPROM), a mask ROM, a flash ROM, a flash memory (e.g., NAND flash or NOR flash), a hard drive, a solid state drive (SSD), or the like).

The external memory may further include a flash drive, for example, compact flash (CF), secure digital (SD), micro secure digital (Micro-SD), mini secure digital (Mini-SD), extreme digital (xD), a multi-media card (MMC), a memory stick, or the like. The external memory may be functionally and/or physically connected with the electronic device 30 through various interfaces.

The sensor unit 315, according to various embodiments, for example, may measure physical quantities and may detect the operation state of the electronic device 30 to thereby convert the measured or detected information to electric signals. The sensor unit 315 may include at least one of: for example, a gesture sensor; a gyro-sensor; an air-pressure sensor; a magnetic sensor; an acceleration sensor; a grip sensor; a proximity sensor; a color sensor (e.g., a red-green-blue (RGB) sensor); a biometric sensor; a temperature/humidity sensor; an illuminance sensor; or an ultra violet (UV) sensor. Alternatively or additionally, the sensor unit, for example, may include an E-nose sensor, an electromyography (EMG) sensor, an electroencephalogram (EEG) sensor, an electrocardiogram (ECG) sensor, an iris sensor, and/or a fingerprint sensor. The sensor unit may further include a control circuit for controlling one or more sensors that are included therein. In some embodiments, the electronic device 30 may further include a control unit as a part of the control unit 303 or separately from the control unit 303, which is configured to control the sensor unit 315 in order to thereby control the sensor unit 315 while the control unit 303 is in the sleep mode.

The input device unit 307, according to various embodiments, for example, may include a touch panel, a (digital) pen sensor, keys, or an ultrasonic input device. The touch panel may use at least one of, for example, a capacitive type, a pressure-sensitive type, an infrared type, or an ultrasonic type. In addition, the touch panel may further include a control circuit. The touch panel may further include a tactile layer in order to thereby provide a user with a tactile reaction.

For example, the (digital) pen sensor may be a part of the touch panel, or may include a separate recognition sheet. The keys may include, for example, physical buttons, optical keys, or a keypad. The ultrasonic input device may detect ultrasonic waves generated in input means through a microphone in order to thereby identify data corresponding to the ultrasonic waves.

The display unit 317, according to various embodiments, may include a panel, a hologram device, or a projector. The panel may be implemented to be, for example, flexible, transparent, or wearable. The panel may be configured with the touch panel as a single module. The hologram device may display 3D images in the air by using interference of light. The projector may display images by projecting light onto a screen. The screen may be positioned, for example, inside or outside the electronic device 30. The display may further include a control circuit for controlling the panel, the hologram device, or the projector.

The audio processing unit 309, for example, may convert a sound into an electric signal, and vice versa. At least some elements of the audio processing unit 309 may process sound information that is input or output through a speaker, a receiver, earphones, or a microphone.

The auditory device 32, according to various embodiments, may change the configuration of the auditory device 32 through the other electronic device 30. The auditory device 32: may be small; may not have a separate display device; and may be comprised of a limited input device unit (buttons) 327. For example, the auditory device 32 may be a type of hearing aid, and may include a plurality of filter modes (e.g., wide dynamic range compression), volume adjustment, or the like. When configuring the mode or volume through the input device unit 327 of the auditory device 32, it may be inconvenient to check the configuration state and to configure a desired mode. For example, when the volume level is changed from 3 to 2 by using a button, the button may be pressed five times (for example, 3→4→5→→1→2). The mode of the auditory device 32 may be conveniently configured when it is configured in association with the other electronic device 30. For example, in the case of using the electronic device 30 that includes a variety of the input device units 307 (touch keys, buttons, or the like) and the display unit 317, a user interface (UI) may be provided to the user through the electronic device 30 so that the user may easily change the configuration of the auditory device 32 according to the provided UI.

The auditory device 32, according to various embodiments, may include a sensor unit 335. The sensor unit 335 may include a proximity sensor, an acceleration sensor, a geomagnetic sensor, a biometric sensor, or the like. The auditory device 32 may identify whether or not the auditory device is worn on the user through the sensor unit 335. The power control mode of the auditory device 32 may be configured by determining whether or not the auditory device is worn on the user. In the case where the auditory device 32 adopts an acceleration sensor, the auditory device may detect whether or not the user moves through the acceleration sensor, and if a specific movement is not detected, the auditory device may operate in the sleep mode.

The auditory device 32, according to various embodiments, may be connected to the mobile electronic device 30 in order to thereby allow the user to hear the sound of a remote place clearly. The auditory device may be used to reproduce and listen to sound sources that are recorded in the mobile electronic device 30, or may be used to convert collected sounds to audio files or text files to then be stored in the mobile electronic device 30. If the input unit (e.g., a microphone) of the mobile electronic device 30 is configured to be a remote microphone in order to hear the sound of the remote place clearly, the auditory device 32 may receive audio signals of the microphone of the mobile electronic device 30. The audio signals of the microphone, which are received in the mobile electronic device 30, may be processed to the compressed data through a data compression operation, and the compressed data may be transmitted to the auditory device 32 through the antenna of the wireless communication unit 325. The auditory device 32 may: receive the data through the antenna of the wireless communication unit 325; separate audio information that is contained in the data format; and reproduce the same through an audio information decompression operation to then be output to a receiver.

The auditory device 32, according to various embodiments, may receive an audio signal that is stored in the mobile electronic device 30 in order to thereby reproduce the same. The mobile electronic device 30 may store a number of alarm sounds. The mobile electronic device 30 may transmit, to the auditory device 32, different alarm sounds depending on the user's situation, the state of a system, time, reception or non-reception of a message, or reception or non-reception of an e-mail to then be reproduced. The auditory device 32 may separate audio information, which is contained in the data format, from the data that is transmitted from the mobile electronic device 30, and may reproduce the same through the audio information decompression operation to then be output to the receiver of the audio processing unit 329.

The auditory device 32, according to various embodiments, may record a signal by using the mobile electronic device 30. The audio data may be stored after being compressed for effective use of the mobile electronic device 30. The mobile electronic device 30 may convert the audio signal into text information by using speech-to-text (STT) technology to then be stored. The mobile electronic device 30 may store text corresponding to a conversation by using the STT method. The text of the conversation may be stored together with a variety of information, such as time information, sensor information, or location information. The stored conversation may be viewed by using the display unit of the mobile electronic device 30. Alternatively, the stored conversation may be converted to an audio signal by using text-to-speech (TTS) technology to then be transmitted to the receiver of the auditory device 32.

The auditory device 32, according to various embodiments, may transmit signals that are received through the microphone to the mobile storage unit 331 to then be stored. In order to reduce the power consumption for transmitting the signal received through the microphone of the auditory device 32 to the mobile electronic device 30, the data signal may be compressed, and then the compressed signal data may be transmitted. The auditory device 32 may include a codec for compressing, or decompressing, the audio data. The signal received through the microphone of the auditory device 32 may be transmitted to the mobile electronic device 30, and may be processed through the speech-to-text conversion to then be stored as text. It may be output to the speaker of the mobile electronic device. The auditory device 32 and the mobile electronic device 30 may be used as communication means between remote places by using the microphone and the receiver.

Figure 4:
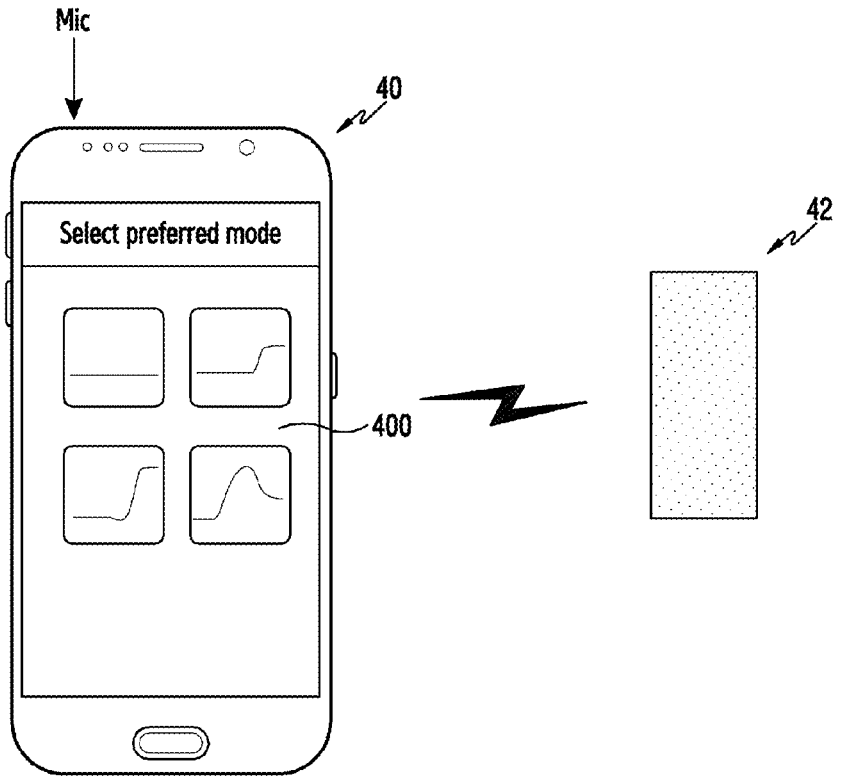
FIG. 4 is a diagram illustrating a wireless communication system, according to an embodiment of the present disclosure.

FIG. 4 is a diagram illustrating a wireless communication system, according to an embodiment of the present disclosure.

Referring to FIG. 4, the auditory device 42, according to various embodiments, may communicate with the other electronic device 40 in order to thereby perform the control and change of the configuration of the auditory device 42. For example, a configuration application for the auditory device 42 may be provided to the mobile electronic device 40 in order to thereby perform the mode control and volume control. The user may display modes that can be configured in the auditory device 42 through the display 400, and may configure a desired mode through an input device (e.g., a touch window). The volume of the auditory device 42 may be adjusted through an input unit (e.g., a volume key) of the other electronic device 40. In addition, the mode may be configured through various sensors (e.g., an acceleration sensor, a gyro sensor, a biometric sensor, a proximity sensor, or the like) of the other electronic device 40 that is connected with the auditory device 42. For example, the auditory device 42 may switch to a configured mode by rocking the mobile terminal left and right, or up and down. The mode information may be changed to the configuration state that conforms to the user's biometric information by using a fingerprint sensor that is provided in the terminal.

Figure 5:
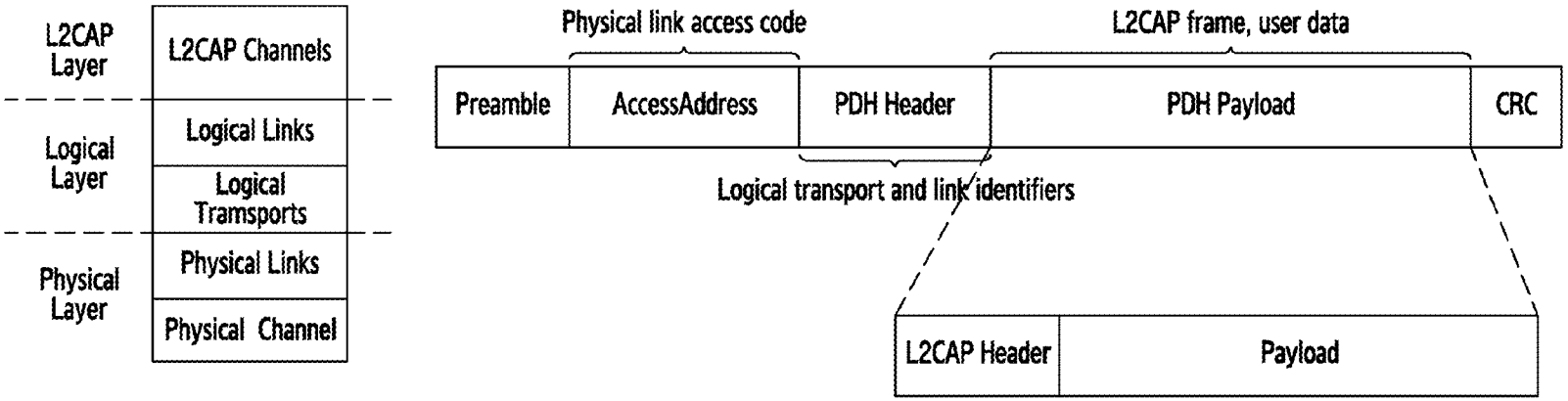
FIG. 5 is a diagram illustrating a data format, according to an embodiment of the present disclosure.

FIG. 5 is a diagram illustrating a data format, according to an embodiment of the present disclosure.

Referring to FIG. 5, in various embodiments, the auditory device and the other electronic device may communicate with each other by using the data format shown in FIG. 5.

For example, the auditory device and the mobile electronic device may communicate wirelessly. In the case of the wireless communication, the BLE (Bluetooth Low Energy) format may be used for the data format, and the data format of AoBLE may be used, which may be modified, in part, to exchange the audio signals. Each electronic device may have L2CAP (Logical Link Control and Adaptation Protocol), logical, and physical layers, and may further include a higher layer. For example, configuration data (such as, voice data, the sampling rate of the audio processing unit (e.g., the codec), the frame size, or activation) may be carried by the PDU payload to be exchanged between the auditory device and the mobile electronic device. The L2CAP header may include an OP code to distinguish the type of data.

Figure 6:
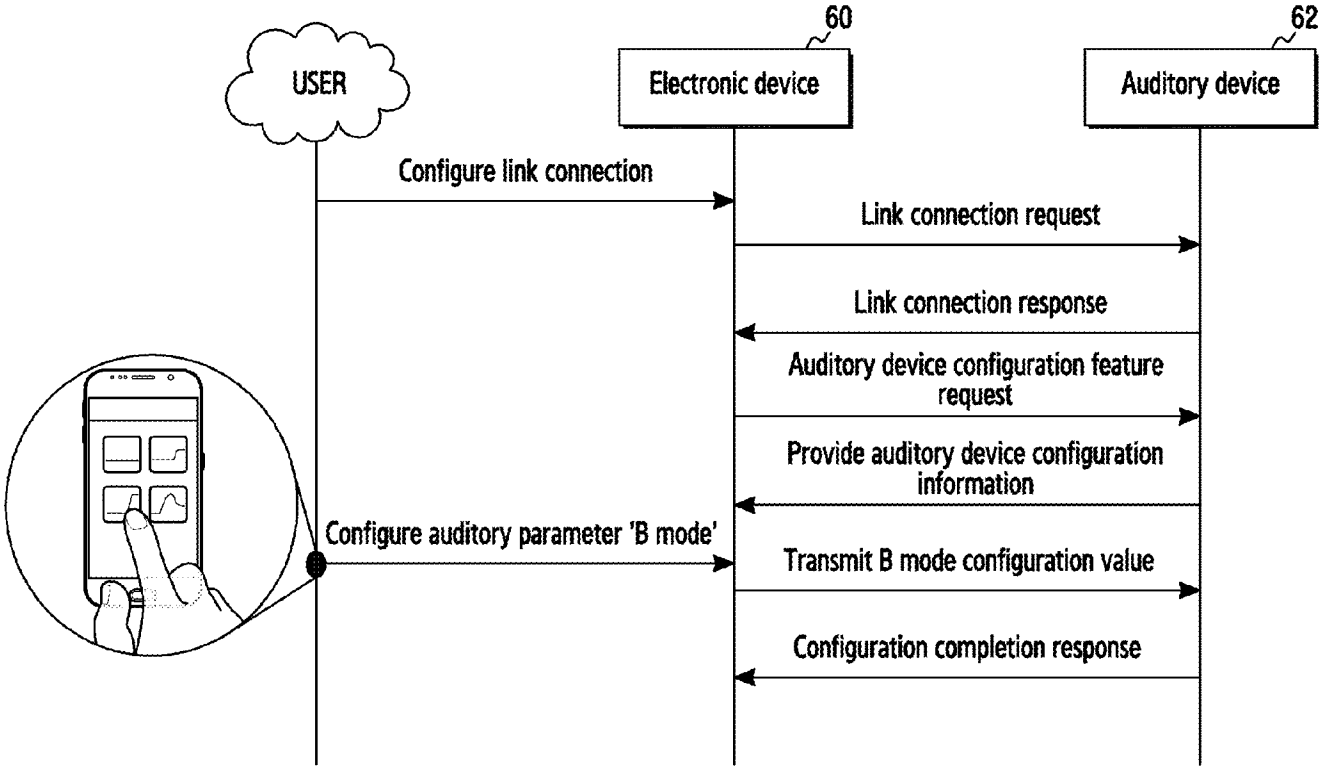
FIG. 6 is a flowchart of a method for changing a configuration of an auditory device in a wireless communication system, according to an embodiment of the present disclosure.

FIG. 6 is a flowchart of a method for changing a configuration of an auditory device in a wireless communication system, according to an embodiment of the present disclosure.

Referring to FIG. 6, the auditory device 62, according to various embodiments, may change the configuration by using the other electronic device 60. For example, the user may proceed with a communication connection with the auditory device 62 by using an input unit of the mobile electronic device 60. If the user inputs a request for a communication connection with the auditory device 62 into the mobile electronic device 60, the mobile electronic device 60 may attempt to perform a communication connection with the auditory device 62. The mobile electronic device 60 may make a request to the auditory device 62 for configured feature information, and the auditory device 62 may transmit the configured information to the mobile electronic device 60. The mobile electronic device 60 may provide the configured data of the auditory device 62 and auditory parameter information that can be configured by the user, and if the user selects a desired auditory parameter, the control unit may update filter information of the audio processing unit (e.g., the codec). After updating the filter information, the mobile electronic device 60 may provide the configuration completion state. The auditory device 62 may perform an initialization operation or the changing of the memory capacity of the auditory device 62 when configuring the auditory parameters.

Figure 7:
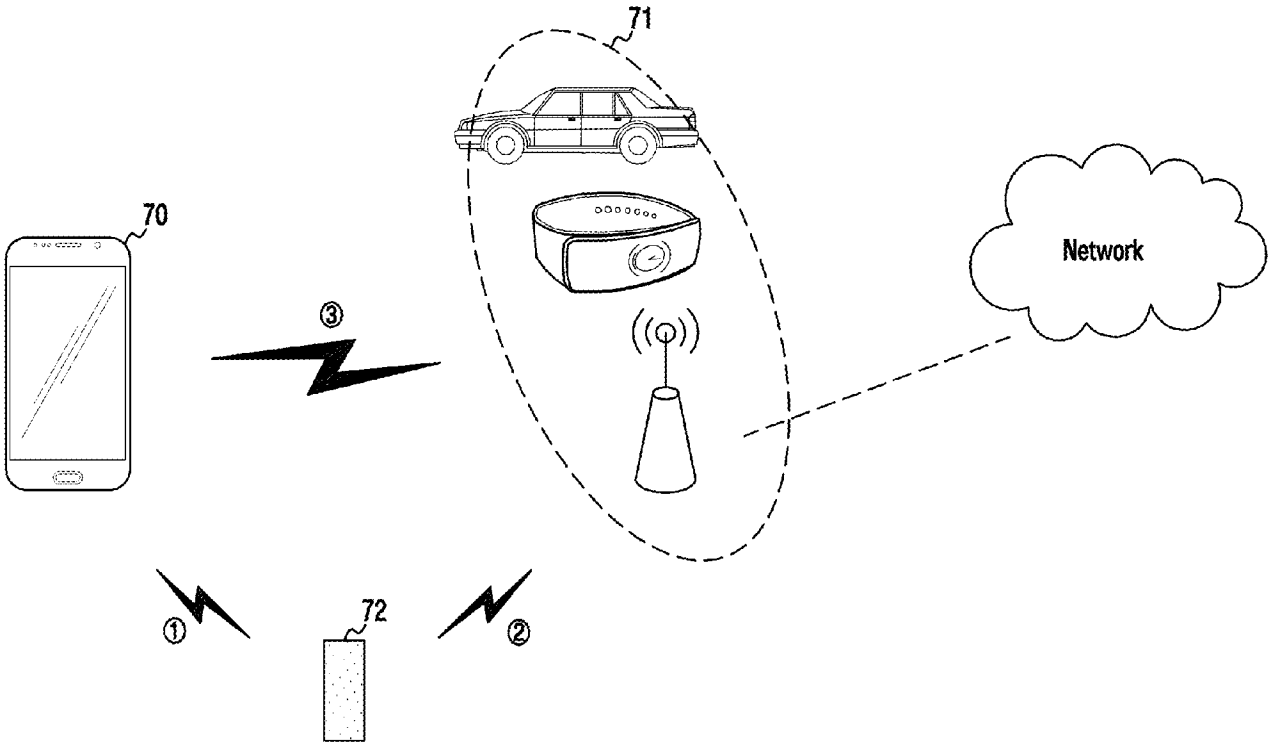
FIG. 7 is a diagram illustrating a wireless communication system, according to an embodiment of the present disclosure.

FIG. 7 is a diagram illustrating a wireless communication system, according to an embodiment of the present disclosure.

Referring to FIG. 7, the auditory device 72, according to various embodiments, may perform the first communication connection (①) with the first electronic device 70. The auditory device 72 may exchange data with the first electronic device 70. For example, audio filter information of the auditory device 72 may be configured through the first electronic device 70. The auditory device 72, according to various embodiments, may perform data communication with the second electronic device 71 or a network through the first electronic device 70. The first electronic device 70 may make the third communication connection (③) with the second electronic devices 71 or the network. The auditory device 72 may exchange data with the second electronic device 71 or the network by using the communication standard that is provided by the first communication device. For example, the auditory device 72 may perform the first communication connection (①) by means of NFMI or BLE, and the first electronic device 70 may perform the third communication connection (③) with the second electronic device 71 or the network (including a connection through a gateway) by means of WiFi. The auditory device 72 may exchange data with the second electronic device 71 or the network by using the first electronic device 70. For example, fitting (audio filter) data may be downloaded through the network, and may be configured. Alternatively, audio data information of the second electronic device 71 may be received to then be output to the auditory device 72.

The auditory device 72, according to various embodiments, may make the second communication connection (②) with the second electronic device 71. The auditory device 72 may support the standard to communicate with the second electronic device 71 or the network. For example, the auditory device 72 may provide the standard for telephony communication (e.g., 3G or long term evolution (LTE)), and may communicate with a base station in order to thereby provide a telephone function.

Figure 8:
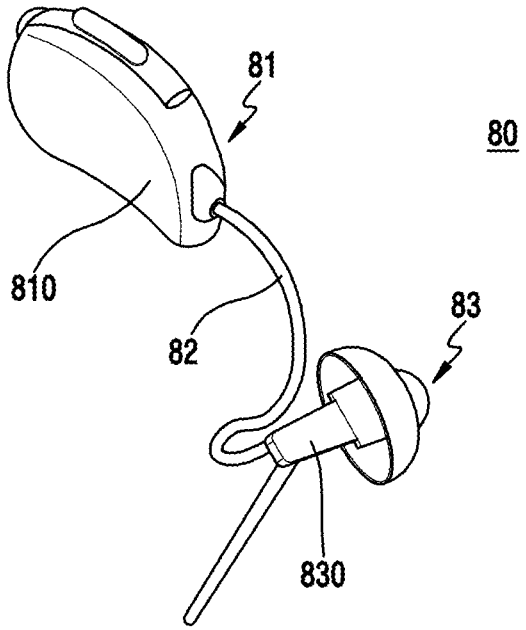
FIG. 8 is a diagram illustrating a configuration of an auditory device, according to an embodiment of the present disclosure.

FIG. 8 is a diagram illustrating a configuration of an auditory device, according to an embodiment of the present disclosure.

Referring to FIG. 8, the auditory device 80, according to various embodiments, may include a body part 81, a tube 82, and a receiver part 83. The hardware (HW) component (e.g., printed circuit boards (PCBs), sensors, or a microphone) configuration, which includes a control unit, may be included in a body part housing 810. The receiver part 83 may be inserted into the ear canal (external auditory meatus) of the user, and may include a receiver 830 to output audio signals in the receiver part housing. At least some of the receiver part 83 may be inserted into the external auditory meatus. The receiver part 83 may include an ear mold in order to provide a comfortable fit to the user. The ear mold may be manufactured as a separate piece form to be coupled to, or detached from, the receiver module. The tube 82 may have a structure for transmitting an audio signal that is processed in the body part 81 to the receiver 830. The tube 82 may be made of a rigid material to keep a specific shape and to help the user in wearing the receiver part in the ear. The tube 82 may be configured to be integral with the body part 81 or the receiver part 83. The tube 82 may be connected to at least a part of the body part 81 or the receiver part 83 by a connector to be detachable. The tube 82 and the receiver part 83 may be integrated with each other, and a part of the body part 81 and a part of the tube 82 may include a connector to be connected with, or detached from, each other. The user may replace the receiver part 83 and the tube 82 when the user feels uncomfortable with the wearing of the auditory device 80. The tube 82 and the receiver part 83 may be provided in various shapes and lengths in order to provide the convenience for the user's wearing.

Figure 9:
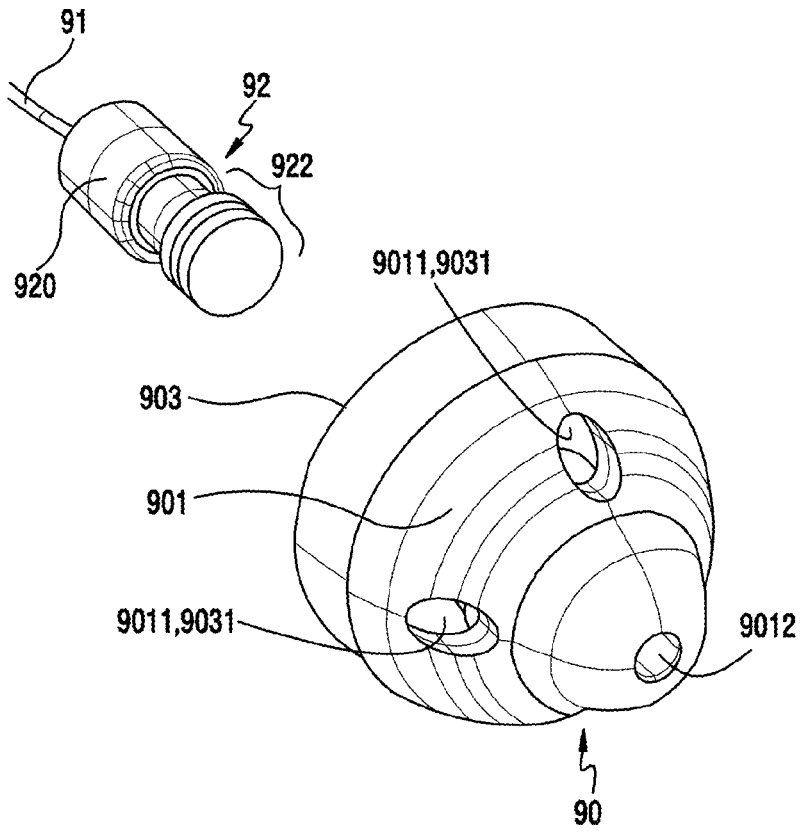
FIG. 9 is a perspective view illustrating a receiver and an ear mold of the auditory device, which are shown separated, according to an embodiment of the present disclosure.

FIG. 9 is a perspective view illustrating a receiver and an ear mold of the auditory device, which are shown separated, according to an embodiment of the present disclosure.

Referring to FIG. 9, the auditory device, according to various embodiments of the present disclosure, may include earphones. The earphones may include earpieces. The earpiece may include a receiver 92. The receiver 92 may convert an electric signal to a sound signal. The receiver 92 may include a body part 920 and one or more locking parts 922. The receiver 92 may be coupled, or connected, to an ear mold 90. The ear mold 90 may be coupled to, or detached from, the earpiece (receiver) 92. The ear mold 90 may be coupled to the earpiece (receiver) by a tight fit, wherein a force, which is equal to or more than a minimum axial force, is applied to the ear mold 90 in the coupling direction so that the earpiece may be coupled to the ear mold 90. The ear mold 90 may provide the user with a proper fit when the receiver 92 is worn in the ear. Therefore, the ear mold 90 may play the role of holding the receiver in the ear (more specifically, in the ear canal). In particular, since the ear mold 90 is made of a soft and flexible material, it may improve the wearing feel. In addition, since the ear mold 90 plays the role of holding the receiver in the ear, around the ear, or in the ear canal, it may be defined to be an ear-canal wearing member or a wearing member. In addition, since the ear mold 90 has a dome shape, it may be referred to as a dome, an ear dome, or a dome member. Alternatively, since the ear mold 90 has a cap shape, it may be referred to as an ear cap, a cap, or a cap member. It should be noted that the ear mold 90 will be interchangeably used with a dome or a cap.

In addition, the ear mold 90, according to various embodiments of the present disclosure, may be disposed between the inner ear and the outer ear to provide a spatial path for connecting the inner ear (the ear tunnel) and the outer ear, or to not provide the same. That is, the provision of the spatial path may be selected according to the user's intention. The aforementioned space may be defined to be the tunnel type of space, which includes the ear canal.

In addition, when the path for connecting the inner ear and the outer ear is provided, the ear mold 90 may be defined to be in the open state, whereas, when the path for connecting the inner ear and the outer ear is not provided, the ear mold 90 may be defined to be in the closed state. The spatial path may be implemented by a through hole or a through opening, which is formed in the ear mold 90.

The ear mold 90 may include a plurality of ear domes 901 and 903, and the ear domes 901 and 903 may have dome halls 9011 and 9031, respectively. The dome holes 9011 and 9031 may be a path for connecting the inside and the outside of the ear when the receiver 92 is worn.

Figure 13A:
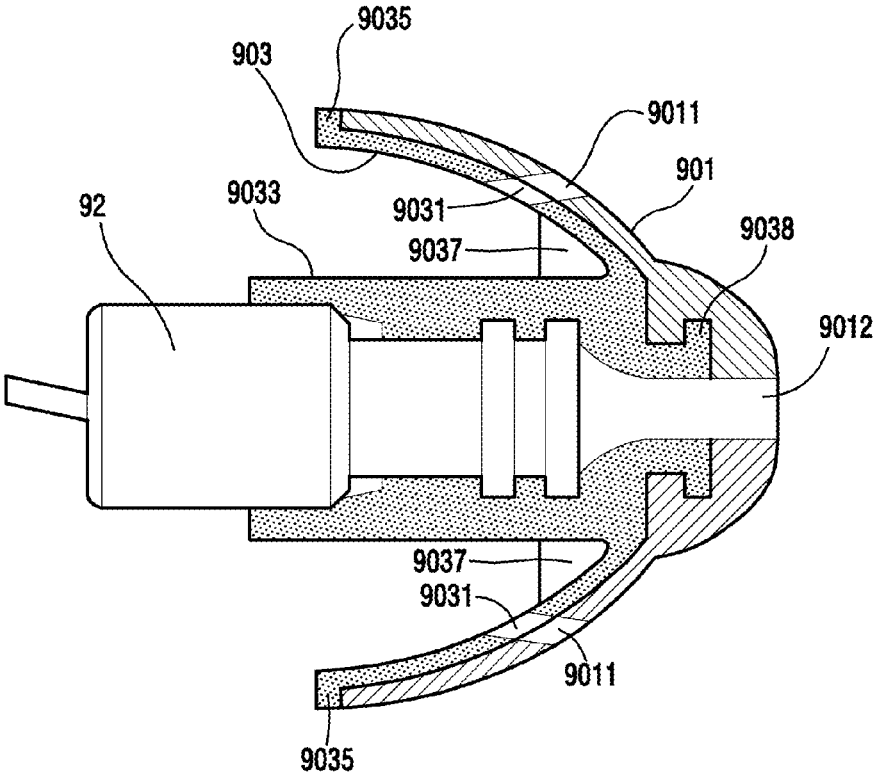
FIG. 13A is a partial, cross-sectional view illustrating a configuration of an auditory device, according to an embodiment of the present disclosure.
Figure 13B:
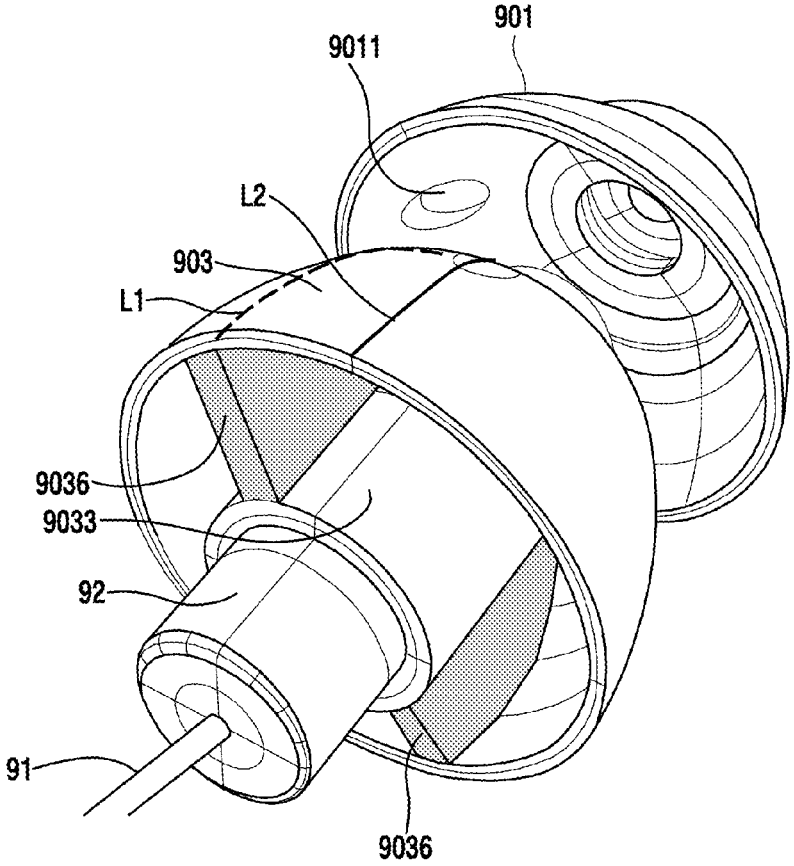
FIG. 13B is a perspective view illustrating the second ear dome, to which a receiver of the auditory device is coupled, and the first ear dome shown are separated, according to an embodiment of the present disclosure.
Figure 14:
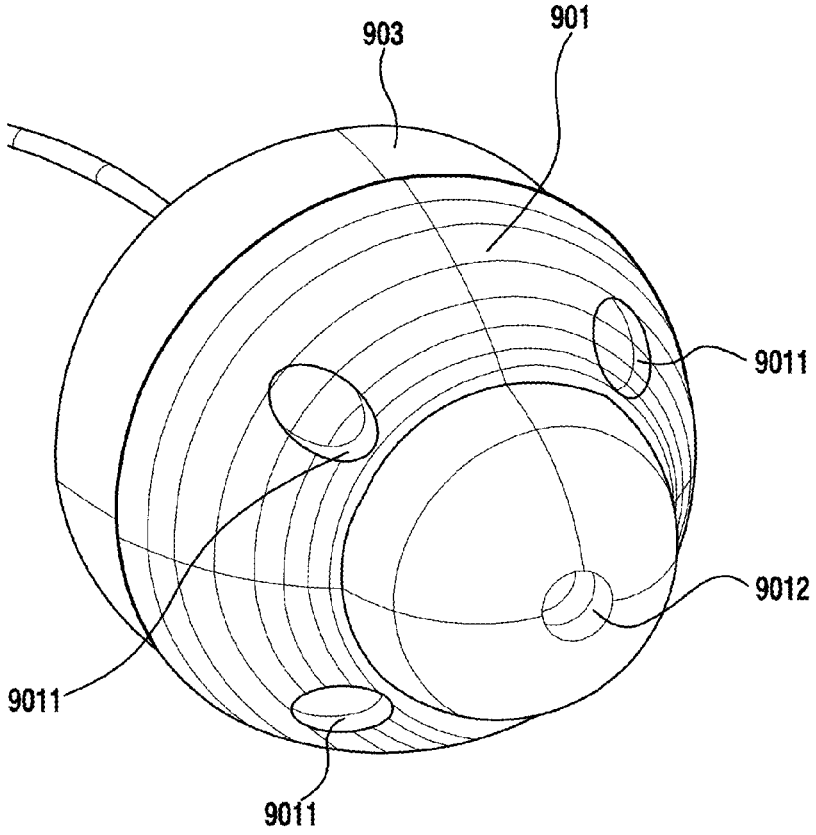
FIG. 14 is a perspective view illustrating an ear mold in an open state, with a receiver of the auditory device and the first and second ear domes coupled to each other, according to an embodiment of the present disclosure.
Figure 15:
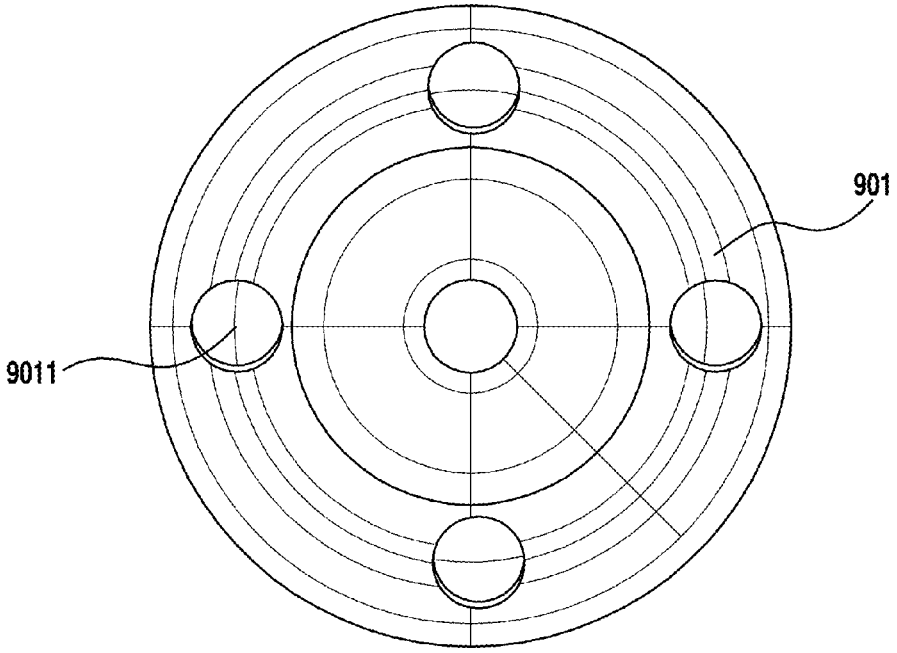
FIG. 15 is a front view of FIG. 14, according to an embodiment of the present disclosure.
Figure 16:
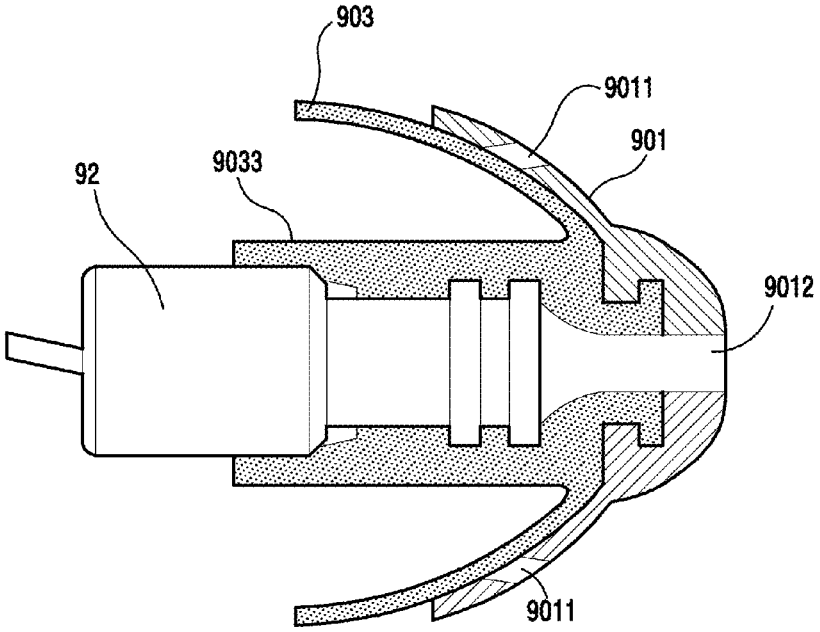
FIG. 16 is a partial, cross-sectional view of FIG. 14, according to an embodiment of the present disclosure.

FIGS. 10 to 13 are views showing the state in which the path for connecting the inner ear and the outer ear is provided. FIGS. 14 to 16 are views showing the state in which the path for connecting the inner ear and the outer ear is not provided.

Figure 10:
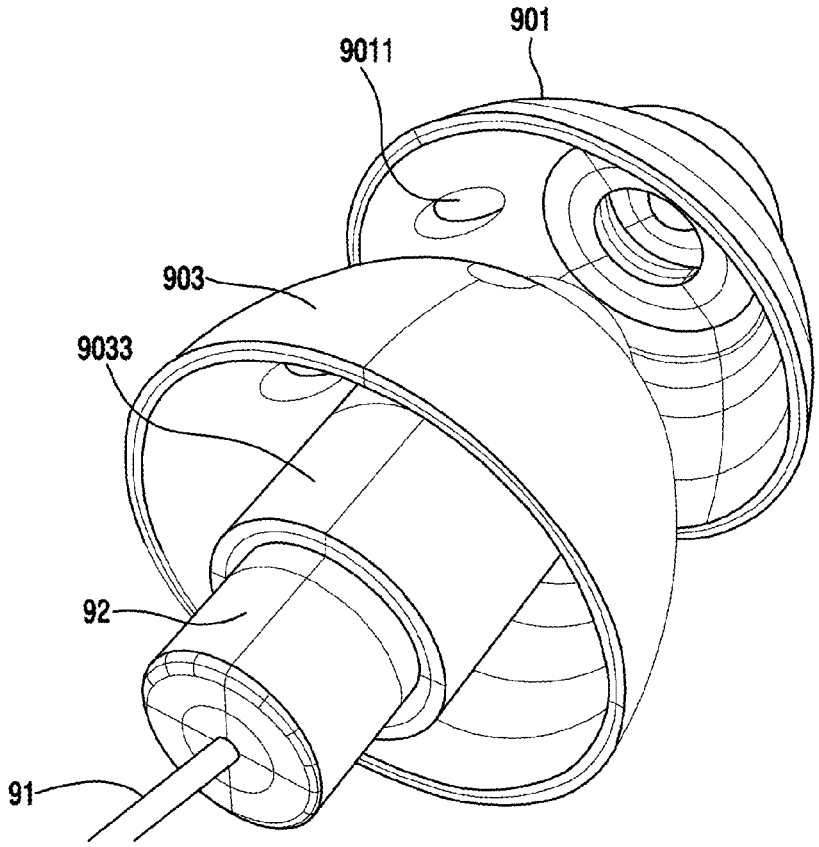
FIG. 10 is a perspective view illustrating a second ear dome, to which a receiver of the auditory device is coupled, and a first ear dome, which are shown separated, according to an embodiment of the present disclosure.
Figure 11:
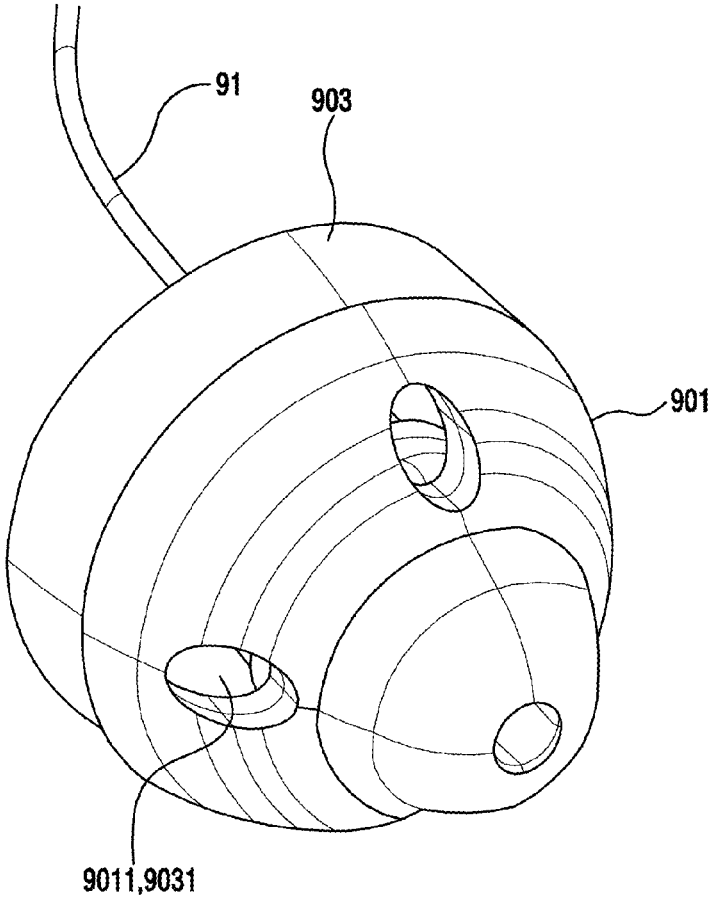
FIG. 11 is a perspective view illustrating an ear mold in an open state, with a receiver of the auditory device and the first and second ear domes coupled to each other, according to an embodiment of the present disclosure.
Figure 12:
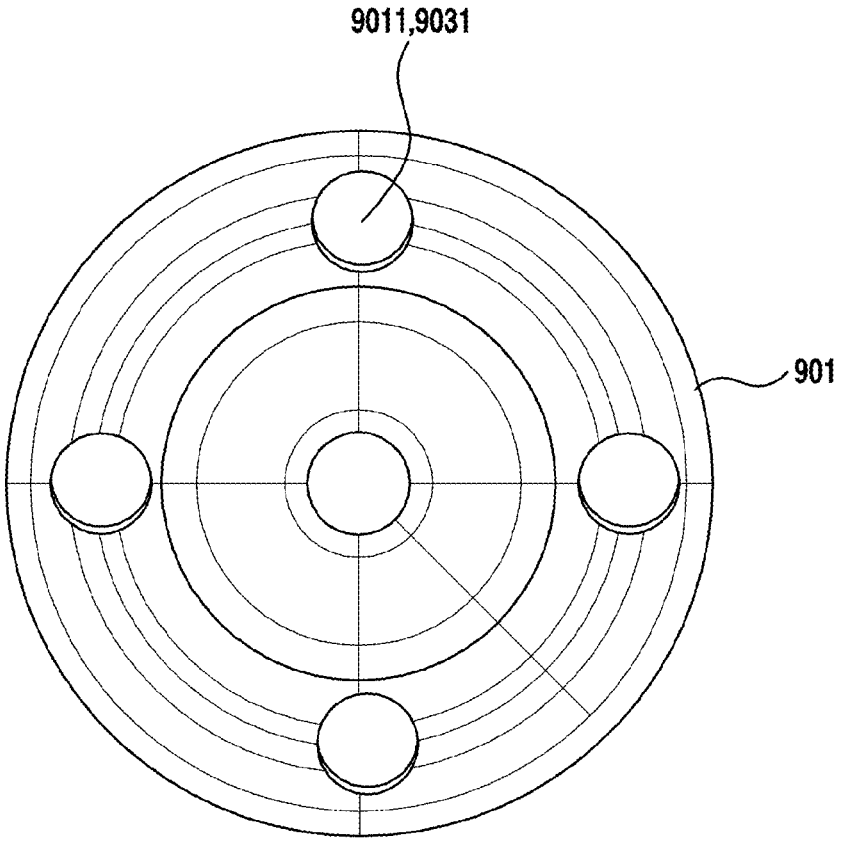
FIG. 12 is a front view of FIG. 11, according to an embodiment of the present disclosure.

FIG. 10 is a perspective view illustrating a second ear dome, to which a receiver of the auditory device is coupled, and a first ear dome, which are shown separated, according to an embodiment of the present disclosure. FIG. 11 is a perspective view illustrating an ear mold in an open state, with a receiver of the auditory device and the first and second ear domes coupled to each other, according to an embodiment of the present disclosure. FIG. 12 is a front view of FIG. 11, according to an embodiment of the present disclosure. FIG. 13A is a partial, cross-sectional view illustrating a configuration of an auditory device, according to an embodiment of the present disclosure, and FIG. 13B is a perspective view illustrating the second ear dome, to which a receiver of the auditory device is coupled, and the first ear dome shown are separated, according to an embodiment of the present disclosure.

Referring to FIGS. 10 to 12, the ear mold 90 may include a plurality of ear domes 901 and 903, and the ear domes 901 and 903 may have the dome holes 9011 and 9031, respectively. The first ear dome 901 or the second ear dome 903 may be soft and pliable to the user's ear canal.

Since the dome holes 9011 and 9031 may be paths extending through the inner ear and the outer ear, the dome holes 9011 and 9031 may be referred to as through holes. Therefore, the dome holes 9011 and 9031 may be interchangeably used with the through holes. The dome holes may include the first and second dome holes 9011 and 9031. The first dome holes 9011 may be formed to penetrate between the first side of the first ear dome 901 and the second side, which is the opposite side of the first side. The second dome holes 9031 may be formed to penetrate between the third side of the second ear dome 903 and the fourth side, which is the opposite side of the third side. The first and second dome holes 9011 and 9031 may be formed in one direction, respectively. The one direction may be the direction in which a receiver mounting part is extended.

The dome holes 9011 and 9031 may be paths for connecting the inside and the outside of the ear when the receiver 92 is worn. The receiver 92 of the auditory device is not limited to an approximately cylindrical shape, and may be formed in a variety of shapes. For example, the receiver 92 may be formed in an approximately cylindrical shape, or in a square pillar shape. The ear domes shown in FIG. 9 may include the first and second ear domes 901 and 903. One ear dome, which is disposed remotely from the receiver 92, may be defined to be the first ear dome 901, and the other ear dome, which is disposed to be close to the receiver 92, may be defined to be the second ear dome 903.

According to various embodiments of the present disclosure, a sound hole 9012 may be provided in the first ear dome 901. The sound hole 9012 may be an opening through which the audio signal, which is output from the receiver 92, passes. The output of the receiver 92 may be made through the sound hole 9012. Since a sound passes through the sound hole 9012, the sound hole 9012 may be referred to as a through hole.

The first ear dome 901 and the second ear dome 903 may be arranged side by side so that the first dome hole 9011 of the first ear dome and the second dome hole 9031 of the second ear dome may be aligned with each other. The receiver 92 may be coupled to a part of the ear mold. The coupling structure of the receiver will be described later.

The second ear dome 903, according to various embodiments, may include a receiver mounting part 9033 in a cylindrical shape. The receiver mounting part 9033 may be extended along the direction in which the receiver 92 is coupled. The coupling direction may be a central axis. The central axis may be a rotational central axis of the first ear dome 901. The receiver mounting part 9033 may have an inner side that surrounds at least a part of the receiver 92 and an outer side that is formed on the opposite side of the inner side.

The first ear dome 901 may have a portion that surrounds at least a part of the receiver mounting part 9033 and that is spaced apart from the outer side, and may be extended from one end of the receiver mounting part 9033. The second ear dome 903 may be disposed to be adjacent to the first ear dome 901, and at least a part of the second ear dome 903 may be extended to be parallel with at least a part of the first ear dome 901.

The first dome hole 9011 of the first ear dome and the second dome hole 9031 of the second ear dome may be disposed to: fully communicate with each other; overlap, in part, each other (to be aligned at least in part); or not communicate with each other (the offset state). If the first and second dome holes 9011 and 9031 are disposed to communicate with each other, the first and second dome holes 9011 and 9031 may provide a single dome hole together, and may serve as a connecting path that passes through the front side and back side of the dome. This condition may be referred to as the open state of the ear dome, and may mean that a dome hole is provided.

Referring to FIG. 13A, according to various embodiments of the present disclosure, the first ear dome 901 may be coupled to the second ear dome 903 by a coupling structure 9038. For example, the coupling structure may be configured in the form of a groove and a protrusion, which are well known.

According to various embodiments of the present disclosure, the first ear dome 901 may be rotatably coupled to the second ear dome 903. That is, the first ear dome 901 may rotate. According to the rotation of the first ear dome 901, the position of the first dome hole 9011 of the first ear dome may vary. The first dome hole 9011 of first ear dome and the second dome hole 9031 of the second ear dome may be positioned such that they are not adjacent to each other. The number of first dome holes 9011 may be four, and the first dome holes may be formed in the positions at angles of 45°, 135°, 225°, and 315° based on the center of the sound hole 9012. The number of dome holes 9031 of the second ear dome 903 may be four, and the dome holes may be formed in the positions at angles of 90°, 180°, 270°, and 360°.

In addition, the first and second ear domes 901 and 903 may be disposed to come into contact with each other. In other words, at least some of the inner side of the first ear dome 901 may come into contact with at least some of the outer side of the second ear dome 903.

In addition, the end portion 9035 of the second ear dome 903 may wrap around the end portion of the first ear dome 901 in order to thereby provide a smooth appearance. In addition, the second ear dome 903 may have a protruding portion 9038 on the top in order to thereby fix and support the engagement with the first ear dome 901 more strongly.

The second ear dome 903 may have a structure 9037 for reinforcement (support) that is formed thereon. The structure 9037 may have a shape to connect the dome portion and the receiver mounting part 9033 of the second ear dome 903, and may be formed in the position in which the dome hole 9031 is not formed (between dome holes). The size of the structure 9037 may be variable. The structure 9037 may serve as a handle.

Figure 18:
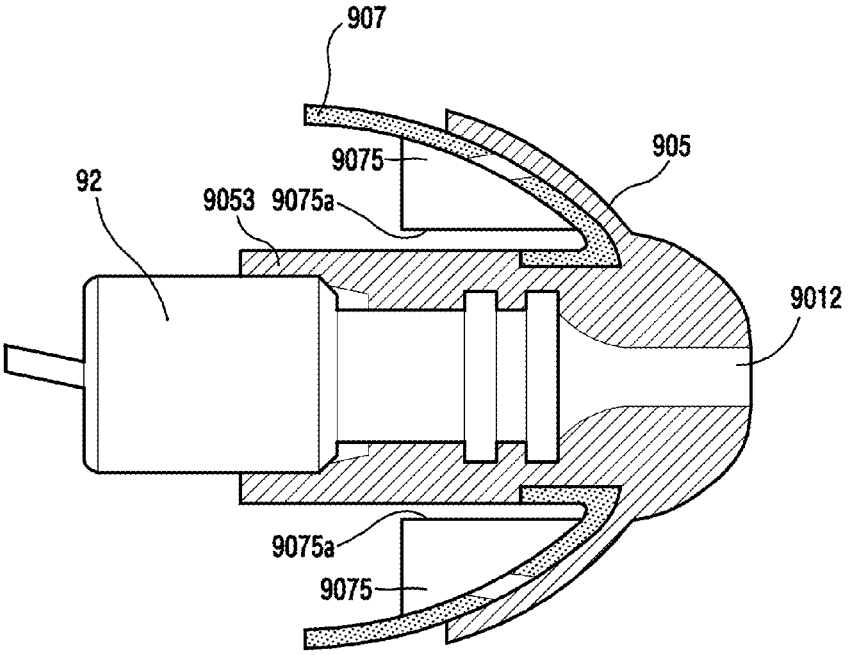
FIG. 18 is a partial, cross-sectional view illustrating a receiver of the auditory device coupled to the second ear dome, according to an embodiment of the present disclosure.

Referring to 13B, one or more structures 9036 for reinforcement (support), or one or more pairs of structures 9036 for reinforcement (support) may be formed on the second ear dome 903. The structure 9036 may have a shape to connect the dome portion with the receiver mounting part 9033 of the second ear dome 903, and may be formed in the area excluding hole position lines L2 in which the dome holes 9031 are formed (for example, may be formed along structure end position lines L1). The size of the structure 9036 may be variable. The structure 9036 may serve as a handle. The structure 9036 may be formed to be extended to the receiver mounting part 9033 (as shown in FIG. 13B), or may be formed to be spaced apart from the receiver mounting part (as shown in FIG. 18).

FIG. 14 is a perspective view illustrating an ear mold in an open state, with a receiver of the auditory device and the first and second ear domes coupled to each other, according to an embodiment of the present disclosure. FIG. 15 is a front view of FIG. 14, according to an embodiment of the present disclosure, and FIG. 16 is a partial, cross-sectional view of FIG. 14, according to an embodiment of the present disclosure.

Referring to FIGS. 14 to 16, at least a part of the receiver 92 may be inserted into the ear mold body part to then be coupled. The first dome hole 9011 of the first ear dome and the second dome hole 9031 of the second ear dome may be positioned to not be adjacent to each other. As shown in the drawings, the angular position of the first dome hole 9011 may be changed so that the dome hole areas may not be shared with each other. This condition may be referred to as the closed state of the ear mold.

According to various embodiments of the present disclosure, the first ear dome 901 and the second ear dome 903 may be separated from each other, and may be coupled to each other again. The first dome hole 9011 of the first ear dome and the second dome hole 9031 of the second ear dome may be positioned to not be adjacent to each other. The number of second dome holes 9031 of the second ear dome may be four, and the second dome holes may be formed in the positions at angles of 45°, 135°, 225°, and 315° based on the center of the sound hole. The number of dome holes 9011 of the first ear dome may be four, and the dome holes may be formed in the positions at angles of 90°, 180°, 270°, and 360°. The positions of the areas of the dome holes of the domes may not be shared. The path passing through the front side and the back side of the ear dome may be eliminated. The number of dome holes formed in each dome is not limited to four.

According to various embodiments of the present disclosure, the spatially connecting path between the inside and the outside of the ear may be created or blocked depending on a change in the position of the dome hole. The user may change the position of the dome hole according to the user's intention in order to thereby create or block the connecting path.

Referring to FIGS. 13A and 16, the first ear dome 901 may be configured to be separated from the second ear dome 903, and the first ear dome 901 may be coupled to the second ear dome 903 through a tight fit by the user. The second ear dome 903 may be fitted to the first ear dome 901 in two manners. First, the second ear dome 903 may be fully fitted to the first ear dome 901 to come into tight contact with each other so that the inside and the outside thereof are blocked in the closed state. Second, the second ear dome 903 may be fitted to the first ear dome 901 to have a gap therebetween so that the inside communicates with the outside in the open state.

Figure 17:
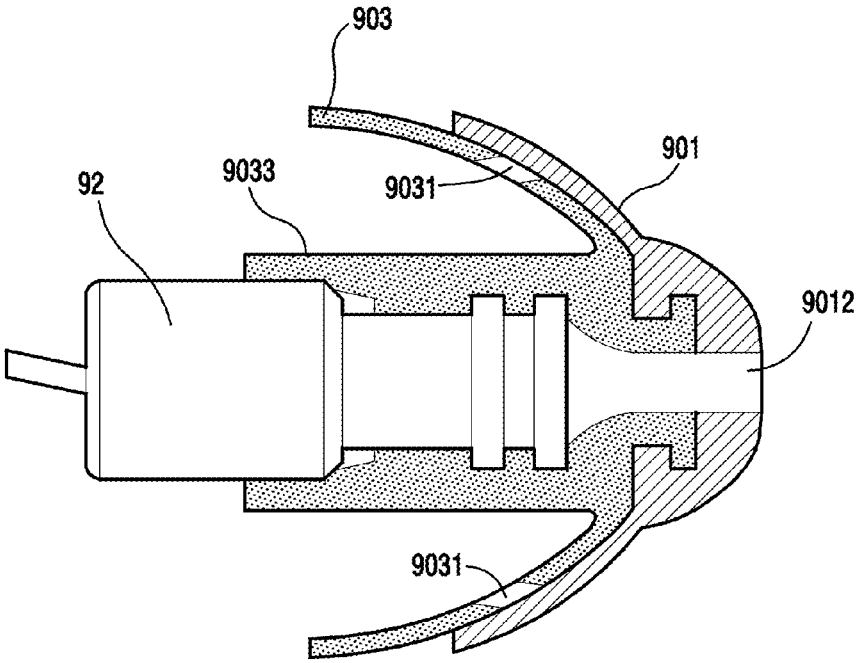
FIG. 17 is a partial, cross-sectional view illustrating a receiver of the auditory device coupled to the first ear dome, according to an embodiment of the present disclosure.
Figure 19:
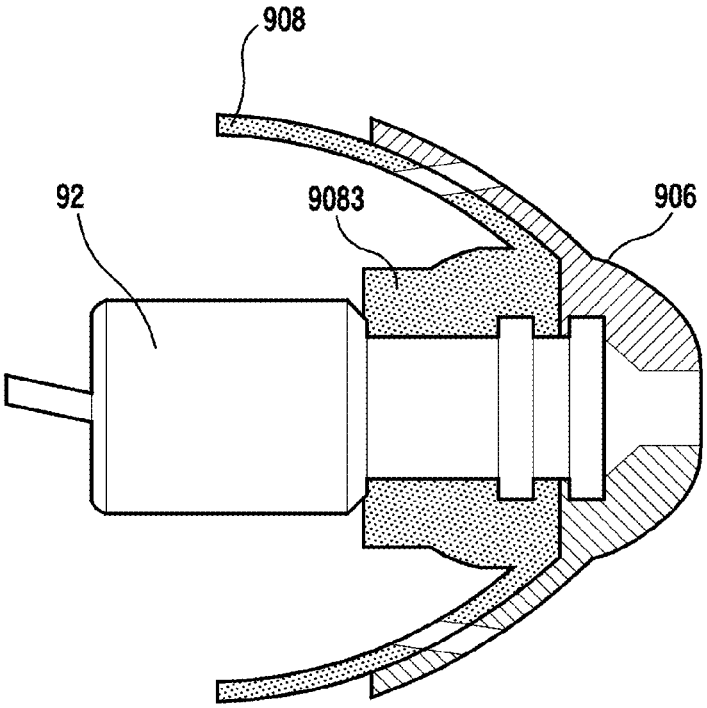
FIG. 19 is a partial, cross-sectional view illustrating a receiver of the auditory device coupled to both the first ear dome and the second ear dome, according to an embodiment of the present disclosure.

Referring to FIGS. 17 to 19, the coupling structure of the ear mold and the receiver 92, according to various embodiments, will be described. The receiver 92, according to various embodiments, may be coupled to: the first ear dome; the second ear dome; or both the first ear dome and the second ear dome. That is, the coupling position of the receiver 92 may exist in: the first ear dome; the second ear dome; or the first ear dome and the second ear dome. In the coupling structure above, the coupling structure to be coupled to the receiver 92 may be made of a rather rigid material, and the first and second ear domes, except for the coupling structure, may be made of a soft and flexible material in order to thereby provide a comfortable wearing feel.

In addition, according to various embodiments of the present disclosure, the length of the first ear dome may be the same as the length of the second ear dome. Alternatively, the first ear dome may be formed to be longer than the second ear dome so that the first ear dome may fully cover the second ear dome.

In addition, according to various embodiments of the present disclosure, the number of dome holes, which are formed in the first ear dome and the second ear dome, may be more, or less, than the illustrated embodiment.

In addition to the two domes shown in the drawing, according to various embodiments of the present disclosure, three or more domes may be provided.

In addition, according to various embodiments of the present disclosure, the sizes of the dome holes in each ear dome may be configured to be different from each other.

In addition, according to various embodiments of the present disclosure, display protrusions may be formed to show the alignment, or misalignment, of the dome holes in order to guide the user when the first ear dome rotates.

FIG. 17 is a partial, cross-sectional view illustrating a receiver of the auditory device coupled to the first ear dome, according to an embodiment of the present disclosure.

Referring to FIG. 17, the receiver 92 may be coupled to the second ear dome 903. The coupling structure (the receiver mounting part 9033) to be coupled to the receiver 92 may be positioned in the second ear dome 903. The receiver 92 may have the locking structure 922 (shown in FIG. 9), and the locking structure 922 may include a locking groove and a locking protrusion. The coupling structure 9033 may be provided in a shape corresponding to the locking structure 922 that is provided in the receiver. The receiver 92 may be coupled to, or detached from, the coupling structure by a tight fit.

FIG. 18 is a partial, cross-sectional view illustrating a receiver of the auditory device coupled to the second ear dome, according to an embodiment of the present disclosure.

Referring to FIG. 18, according to various embodiments of the present disclosure, the receiver 92 may be coupled to the first ear dome 905. That is, the coupling structure (a receiver mounting part 9053) to be coupled to the receiver 92 may be positioned in the first ear dome 905. The receiver 92 may have the locking structure 922 (shown in FIG. 9), and the locking structure 922 may include a locking groove and two locking protrusions. The coupling structure 9053 may be provided in a shape corresponding to the locking structure that is provided in the receiver 92. The receiver 92 may be coupled to, or detached from, the coupling structure 9053 by a tight fit.

In addition, the second ear dome 907 may have a structure 9075 for reinforcement (support), which is formed therein in order to easily rotate the second ear dome 907 during the rotation operation. The structure 9075 may be formed in the portion in which the dome holes are not formed (see FIG. 13B). The size of the structure 9075 may be variable. The structure 9075 may serve as a handle for the rotation operation. In addition, the structure 9075, which serves as the handle, may be formed to be spaced apart from the receiver mounting part 9053. The inner side 9075*a* of the structure may face the outer side of the receiver mounting part 9053.

FIG. 19 is a partial, cross-sectional view illustrating a receiver of the auditory device coupled to both the first ear dome and the second ear dome, according to an embodiment of the present disclosure.

Referring to FIG. 19, according to various embodiments of the present disclosure, the receiver 92 may be coupled to both the first dome 906 and the second ear dome 908. That is, the coupling structure 9083 to be coupled to the receiver 92 may be positioned in the first ear dome 906 and the second ear dome 908, respectively. The receiver 92 may have the locking structure 922 (shown in FIG. 9), and the locking structure 922 may include a locking groove and two locking protrusions. One locking protrusion may be coupled to the receiver mounting part of the first ear dome 906, and the other locking protrusion may be coupled to the receiver mounting part of the second ear dome 908. The coupling structure 9083 may be provided in a shape corresponding to the locking structure that is provided in the receiver. The receiver 92 may be coupled to, or detached from, the coupling structure by a tight fit.

Figure 20:
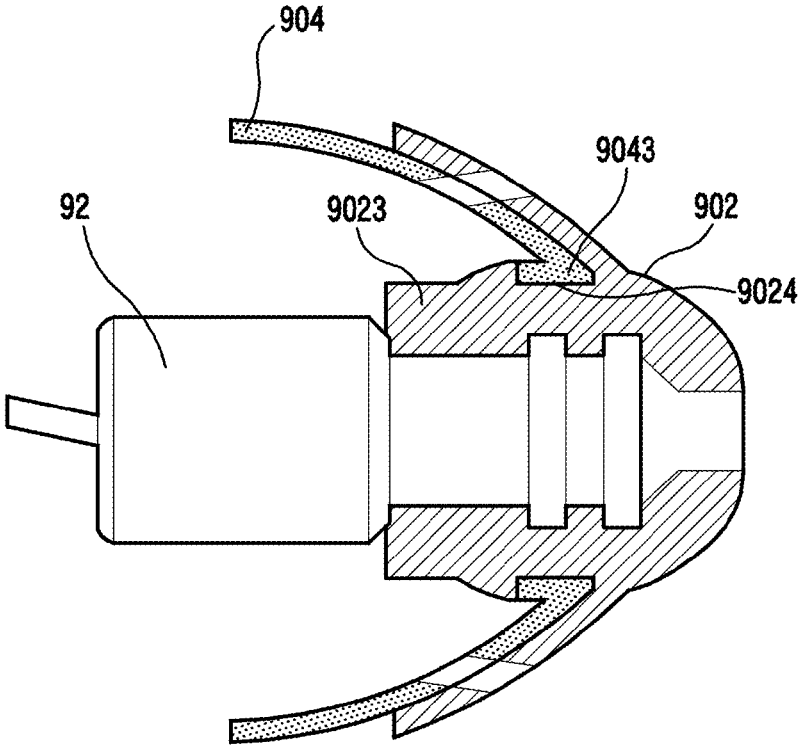
FIG. 20 is a partial, cross-sectional view illustrating a receiver of the auditory device coupled to the first ear dome, according to an embodiment of the present disclosure.

FIG. 20 is a partial, cross-sectional view illustrating a receiver of the auditory device coupled to the first ear dome, according to an embodiment of the present disclosure.

Referring to FIG. 20, according to various embodiments of the present disclosure, the receiver 92 may be coupled to the first ear dome 902. That is, the cylindrical coupling structure 9023 (the receiver mounting part) to be coupled to the receiver 92 may be positioned in the first ear dome 902. The receiver 92 may have the locking structure 922 (shown in FIG. 9), and the locking structure 922 may include a locking groove and two locking protrusions. The locking structure may be coupled to the receiver mounting part 9023 provided in the first ear dome 902. The coupling structure 9023, such as the receiver mounting part, may be provided in a shape corresponding to the locking structure that is provided in the receiver 92. The receiver 92 may be coupled to, or detached from, the coupling structure 9023 by a tight fit. An engagement groove 9024 may be formed on the outer circumferential surface of the first ear dome 902, and an inner portion 9043 of the second ear dome may be engaged with the engagement groove 9024.

Figure 21:
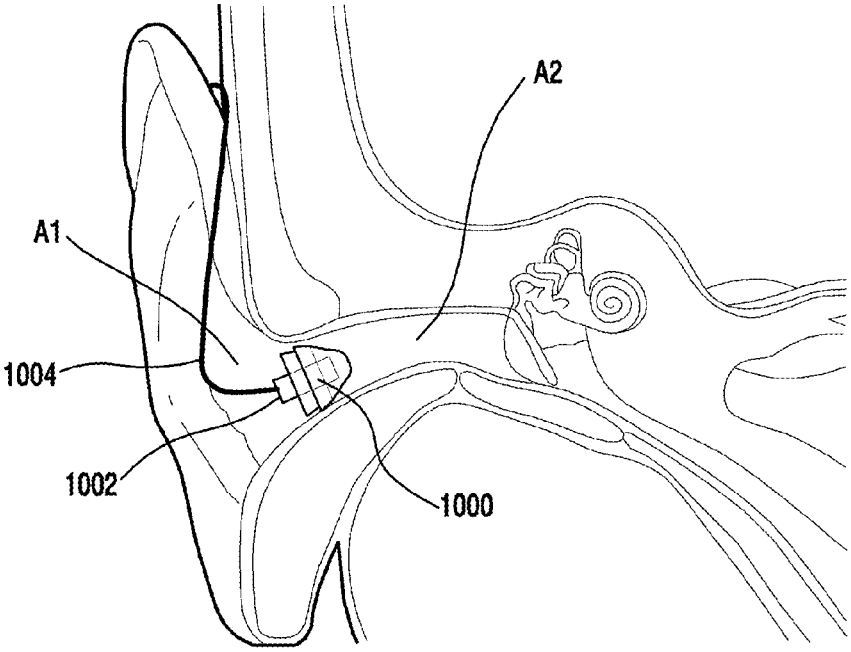
FIG. 21 is diagram illustrating the auditory device being worn in an ear canal of a user, according to an embodiment of the present disclosure.

FIG. 21 is diagram illustrating the auditory device being worn in an ear canal of a user, according to an embodiment of the present disclosure.

FIG. 21 shows the state in which the ear mold 1000, to which the receiver 1002 is coupled, is disposed in the connecting path between the inner ear (external auditory meatus) (A2) and the outer ear (acoustic meatus) (A1). The spatial path for connecting the inner ear (A2) and the outer ear (A1) may be provided, or may not be provided, according to the change in the state of the ear mold 1000.

According to various embodiments, at least some of the devices (for example, modules or functions thereof) or the method (for example, operations) according to the present disclosure may be implemented by a command stored in a non-transitory computer-readable storage medium in a programming module form. When the command is executed by one or more processors (for example, the processor 210), the one or more processors may execute a function corresponding to the command. The computer-readable storage medium may be, for example, the memory 220. At least some of the programming modules may be implemented (for example, executed) by, for example, the processor. At least some of the programming modules may include, for example, a module, a program, a routine, a set of instructions or a process for performing one or more functions.

The non-transitory computer readable recording medium may include magnetic media such as a hard disc, a floppy disc, and a magnetic tape, optical media such as a compact disc read only memory (CD-ROM) and a digital versatile disc (DVD), magneto-optical media such as a floptical disk, and hardware devices specifically configured to store and execute program commands, such as a read only memory (ROM), a random access memory (RAM), and a flash memory. In addition, the program instructions may include high class language codes, which can be executed in a computer by using an interpreter, as well as machine codes made by a compiler. The aforementioned hardware device may be configured to operate as one or more software modules in order to perform the operation of the present disclosure, and vice versa.

The programming module according to the present disclosure may include one or more of the aforementioned components or may further include other additional components, or some of the aforementioned components may be omitted. Operations executed by a module, a programming module, or other component elements according to various embodiments of the present disclosure may be executed sequentially, in parallel, repeatedly, or in a heuristic manner. Further, some operations may be executed according to another order or may be omitted, or other operations may be added.

While the present disclosure has been shown and described with reference to certain embodiments thereof, it will be understood by those skilled in the art that various changes in form and details may be made therein without departing from the scope of the present disclosure. Therefore, the scope of the present disclosure should not be defined as being limited to the embodiments, but should be defined by the appended claims and equivalents thereof.

What is claimed is:

1. A portable device comprising:

an earpiece including a receiver configured to convert an electric signal into a sound signal; and an ear mold configured to be coupled to the earpiece and comprising:

a cylinder formed about a first axis of the ear mold and including an inner side that surrounds at least a part of the receiver and an outer side that is disposed opposite the inner side;

a first cap extending from one end of the cylinder and including a portion spaced apart from the outer side of the cylinder and surrounding at least a part thereof; and a second cap disposed adjacent to the first cap and extending parallel in relation to at least a part of the first cap, wherein the first cap has a first hole passing through a first side of the first cap and a second side, which is disposed opposite the first side, and the second cap has a second hole passing through a third side of the second cap and a fourth side, which is disposed opposite the third side, wherein if the first hole and the second hole are aligned with each other, the ear mold is in an open configuration for allowing a sound signal to pass through the first hole and second hole, and if the first hole and the second hole are not aligned with each other, the ear mold is in a closed configuration for preventing the sound signal from passing through the first hole and second hole.

2. The device of claim 1, wherein the second cap is configured to rotate about the first axis with respect to the first cap.

3. The device of claim 1, wherein the first hole and the second hole are alignable with respect to each other according to rotation of the second cap with respect to the first cap.

4. The device of claim 1, wherein the first hole and the second hole are formed along the first axis.

5. The device of claim 1, wherein the second cap includes a third hole that is configured to allow the sound signal output from the receiver to pass through the third hole.

6. The device of claim 1, wherein the first cap and the cylinder are integrally formed with each other.

7. The device of claim 1, wherein at least one of the first cap and the second cap is made from a first material that is soft and pliable for insertion into a user's ear canal.

8. The device of claim 7, wherein the cylinder is made from a second material that is harder than the first material, which forms at least one the first cap and the second cap.

9. The device of claim 1, wherein the ear mold is detachable from the earpiece.

10. The device of claim 1, wherein the ear mold is coupled to the earpiece by positioning the ear mold into the earpiece and applying a force to the ear mold in the first axis.

11. The device of claim 1, wherein the earpiece further includes an earphone.

12. An auditory device comprising:

a receiver; and at least one ear mold coupleable to the receiver and operable in a first configuration and a second configuration, such that in the first configuration a through hole of the ear mold is in an open configuration and in the second configuration the through hole is in a closed configuration, wherein the at least one ear mold further comprises:

a first ear dome; and a second ear dome that is rotatably coupled to the first ear dome such that the first ear dome rotates about the second ear dome for operating the at least one ear mold in the first configuration and the second configuration, wherein the first ear dome includes at least one first through hole and the second ear dome includes at least one second through hole, and wherein if the at least one first through hole and the at least one second through hole are aligned with each other, the ear mold is in the open configuration for allowing a sound signal to pass through the through hole, and if the at least one first through hole and the at least one second through hole are not aligned with each other, the ear mold is in the closed configuration for preventing the sound signal from passing through the through hole.

13. The auditory device of claim 12, wherein the through hole operates as a path to connect an inner ear of a user to an outer ear of a user.

14. The auditory device of claim 12, wherein the receiver is one of coupled to at least one of the first ear dome and the second ear dome and coupled to both the first ear dome and the second ear dome by a first coupling structure, and wherein the first ear dome is rotatably coupled to the second ear dome by a second coupling structure.

15. The auditory device of claim 12, wherein the second ear dome includes a receiver mounting part for coupling the receiver to the ear dome.

16. The auditory device of claim 15, further comprising at least one of a handle and a pair of handles configured to facilitate rotation between the second ear dome and the receiver mounting part, wherein the at least one of a handle and a pair of handles are positioned between through hole position lines in the second ear dome.

17. The auditory device of claim 16, wherein the at least one of a handle and a pair of handles one of integrally connects the second ear dome to the receiver mounting part and includes a structure that is integrally formed with the second ear dome and spaced apart from the receiver mounting part.

18. A wearable device comprising:

an ear mold coupleable to a receiver and operable in an open configuration for opening a path between an inner ear and an outer ear of a user of the wearable device and a closed configuration for blocking the path between the inner ear and the outer ear, wherein the ear mold further comprises:

a first ear dome; and a second ear dome that is rotatably coupled to the first ear dome such that the first ear dome rotates about the second ear dome for operating the at least one ear mold in the first configuration and the second configuration, wherein the first ear dome includes at least one first through hole and the second ear dome includes at least one second through hole, and wherein if the at least one first through hole and the at least one second through hole are aligned with each other, the ear mold is in the open configuration for allowing a sound signal to pass through a through hole of the ear mold, and if the at least one first through hole and the at least one second through hole are not aligned with each other, the ear mold is in the closed configuration for preventing the sound signal from passing through the through hole.

* * * * *